US006899409B2

(12) United States Patent
Kusunoki

(10) Patent No.: US 6,899,409 B2
(45) Date of Patent: May 31, 2005

(54) APPARATUS FOR DRIVING INK JET HEAD

(75) Inventor: Ryutaro Kusunoki, Mishima (JP)

(73) Assignee: Toshiba Tec Kabushiki Kaisha (JP)

( * ) Notice: Subject to any disclaimer, the term of this patent is extended or adjusted under 35 U.S.C. 154(b) by 0 days.

(21) Appl. No.: 10/607,042

(22) Filed: Jun. 26, 2003

(65) Prior Publication Data

US 2004/0017413 A1 Jan. 29, 2004

(30) Foreign Application Priority Data

Jun. 28, 2002 (JP) ..... 2002-191072
May 19, 2003 (JP) ..... 2003-140870

(51) Int. Cl.[7] ..... B41J 29/38
(52) U.S. Cl. ..... 347/11
(58) Field of Search ..... 347/10–11, 74, 347/75, 55–57

(56) References Cited

U.S. PATENT DOCUMENTS 4,424,520 A 1/1984 Matsuda et al. ..... 347/11
5,124,716 A 6/1992 Roy et al. ..... 347/11
5,170,177 A 12/1992 Stanley et al. ..... 347/11
5,381,162 A * 1/1995 Roy et al. ..... 347/10
5,461,403 A 10/1995 Wallace et al. ..... 347/10
6,099,103 A 8/2000 Takahashi ..... 347/11
6,109,716 A * 8/2000 Takahashi ..... 347/11
6,296,341 B1 10/2001 Sugahara ..... 347/19

FOREIGN PATENT DOCUMENTS

EP 0 968 822 12/1998
JP 2000-43251 2/2000

OTHER PUBLICATIONS

Communication from EPO re counterpart application No. 03014639.3.

* cited by examiner

*Primary Examiner*—Hai Pham
(74) *Attorney, Agent, or Firm*—Harness, Dickey & Pierce, P.L.C.

(57) ABSTRACT

A drive signal generating unit sequentially generates a first pulse in the shape of a rectangular wave expanding the capacity of a pressure chamber, a second pulse contracting the capacity of the pressure chamber, a third pulse in the shape of a rectangular wave expanding the capacity of the pressure chamber, and a fourth pulse contracting the capacity of the pressure chamber, as drive signals when an ink droplet is ejected after the capacity of the pressure chamber is changed to be expanded or contracted. When ½ of a specific vibration period of the ink in the pressure chamber is defined as 1AL, the time interval between the pulse width center of the first pulse and that of the third pulse is set to 1AL, and the time interval between the pulse width center of the second pulse and that of the fourth pulse is set to 1AL.

8 Claims, 8 Drawing Sheets

APPARATUS FOR DRIVING INK JET HEAD

CROSS-REFERENCE TO RELATED APPLICATIONS

This application is based upon and claims the benefit of priority from the prior Japanese Patent Applications No. 2002-191072, filed Jun. 28, 2002; and No. 2003-140870, filed May 19, 2003, the entire contents of both of which are incorporated herein by reference.

BACKGROUND OF THE INVENTION

1. Field of the Invention

The present invention relates to an apparatus for driving an ink jet head, which ejects an ink droplet from a nozzle by changing the capacity of a pressure chamber for containing an ink therein.

2. Description of the Related Art

For example, in Jpn. Pat. Appln. KOKAI Publication No. 2000-43251, there is described a driving method for carrying out gradation printing by using an ink jet recording apparatus which ejects an ink from a nozzle by changing the capacity of an ink chamber to be expanded or contracted, the ink chamber containing an ink, by using a piezoelectric element.

In this publication, the following description is given. Namely, conventionally, when large-liquid-droplet driving, middle-liquid-droplet driving, and small-liquid-droplet driving are carried out for the purpose of gradation printing, there has been a problem that times for terminating these driving operations vary from one another, and the residual vibration energies also vary from one another. Inevitably, the residual vibration of the ink impose different influences on the ink chambers as the ink chambers are sequentially driven. This results in printing of poor quality. Thus, after a wait time has elapsed according to an ejection liquid quantity from a drive timing when starting a printing operation, the ink chambers are expanded. After a predetermined time interval has elapsed from the drive timing irrespective of the ejection liquid quantity, each of group of ink chambers is controlled so as to contract all the ink chambers. In this manner, the effect of the residual vibration on the ink chambers driven immediately after such control is substantially uniformed irrespective of an ink droplet ejection quantity of the ink chambers driven immediately before such control, thereby enabling stable printing control irrespective of the content of an image signal.

However, in the driving method of this publication, in the case where an ink ejection timing changes due to variety in relative velocity between an ink jet head and a recording medium, or the like, the velocity or volume of ejection ink droplets changes due to the effect of the residual vibration. As a result, there has been a problem with a lowered printing quality such as displacement of ink landing positions or occurrence of variety in printing dot size. In addition, during an ink ejecting operation, unwanted meniscus vibration due to the residual vibration generated immediately preceding ink ejecting operation is added. Therefore, there has been a problem that such an ink ejection operation itself is made unstable.

BRIEF SUMMARY OF THE INVENTION

It is an object of the present invention to provide an apparatus for driving an ink jet head capable of reducing residual vibration of an ink generated in a pressure chamber after ink ejection, thereby enabling control of an ink ejection volume while reducing fluctuation of an ink ejection velocity to the minimum.

According to one aspect of the present invention, there is provided an ink jet head driving apparatus. The ink jet head driving apparatus comprises: a drive signal generating unit which outputs a drive signal for ejecting an ink droplet to an ink jet head having a pressure chamber which contains an ink, a nozzle which communicates with the pressure chamber and ejects the ink in the pressure chamber, and an actuator which changes a capacity of the pressure chamber to be expanded or contracted based on the drive signal, wherein the drive signal generating unit sequentially generates as drive signals for ejecting ink droplets: a first pulse in the shape of a first rectangular wave, which expands the capacity of the pressure chamber; a second pulse in the shape of a second rectangular wave, which contracts the capacity of the pressure chamber; a third pulse in the shape of a third rectangular wave, which expands the capacity of the pressure chamber; and a fourth pulse in the shape of a fourth rectangular wave, which contracts the capacity of the pressure chamber, and a time interval between a pulse width center of the first pulse and a pulse width center of the third pulse is set to 1 AL (1 AL is ½ of an acoustic resonant cycle of the ink in the pressure chamber), and a time interval between a pulse width center of the second pulse and a pulse width center of the fourth pulse is set to 1 AL.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, preferred embodiments of the present invention will be described with reference to the accompanying drawings.

(First Embodiment)

Figure 1:
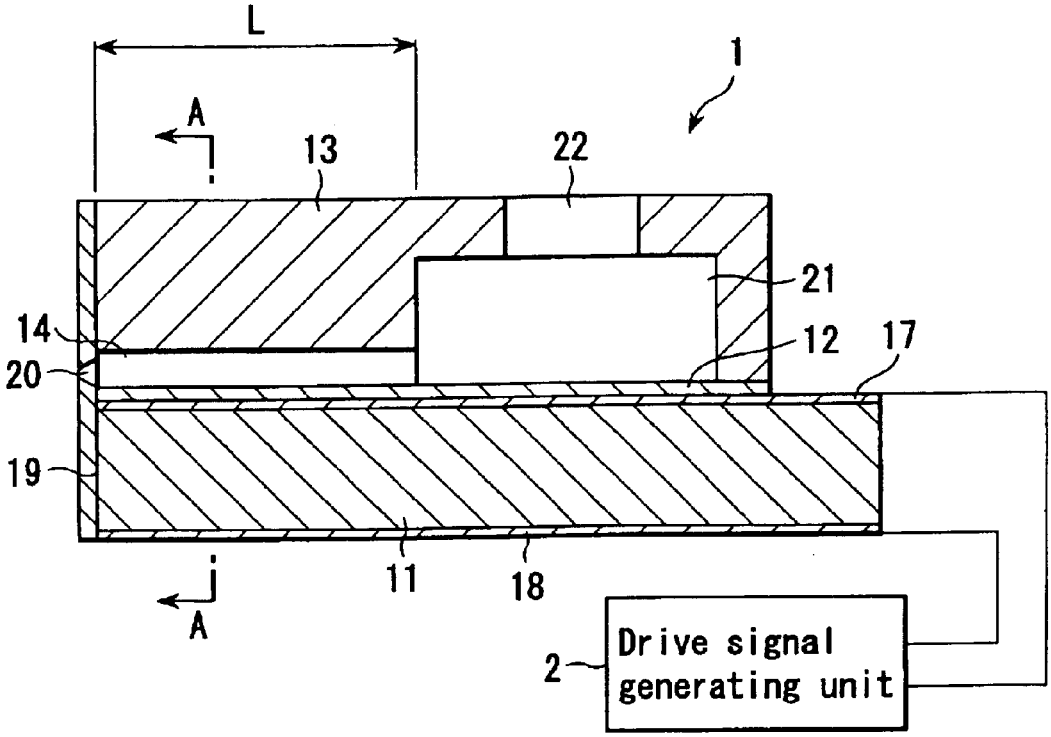
FIG. 1 is a longitudinal cross section including a partial block which depicts a configuration of an ink jet head according to a first embodiment of the present invention.
Figure 2:
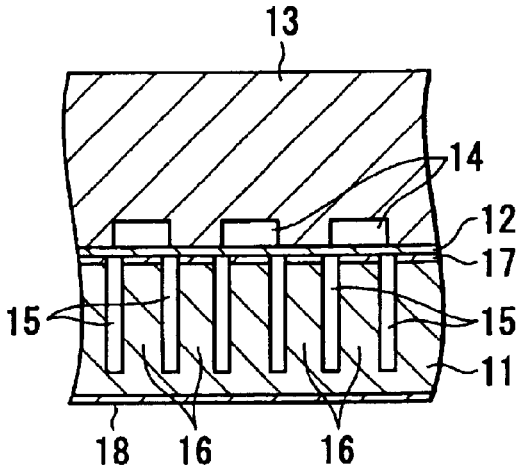
FIG. 2 is a partial transverse cross section taken along the line A—A, of the ink jet head of FIG. 1.

FIG. 1 is a longitudinal cross section including a partial block which depicts a construction of an ink jet head, and FIG. 2 is a fragmental transverse cross section taken along the line A—A of FIG. 1. In the figures, reference numeral 1 denotes an ink jet head, and reference numeral 2 denotes drive signal generating unit which configures a drive unit.

In the ink jet head 1, a top plate 13 is laminated via a vibration plate 12 on a substrate 11 constituted of a piezoelectric member. Then, on the top plate 13, a plurality of elongated grooves in a longitudinal direction are formed in a transverse direction with a predetermined pitch. A plurality of pressure chambers 14 are formed by each groove and the vibration plate 12.

On the substrate 11 opposed to both side walls in each of the pressure chambers 14, a groove 15 is formed such that piezoelectric members individually are actuated as actuators on each pressure chamber 14. Individual electrodes 17 are formed, respectively, between each actuator 16 and the vibration plate 12. A common electrode 18 is formed on a bottom face of the substrate 11. The individual electrodes 17 and the common electrode 18 are connected to an output terminal of the drive signal generating unit 2.

A nozzle plate 19 is adhered at a tip end of the ink jet head 1, i.e., at a tip end of the substrate 11 and top plate 13. On this nozzle plate 19, a plurality of nozzles 20 which communicate external with each of the pressure chambers 14 are formed with a predetermined pitch.

A common pressure chamber 21 which communicates with each pressure chamber 14 at the rear of the pressure chamber is formed in the ink jet head 1. In this common pressure chamber 21, an ink is injected from ink supply means (not shown) via an ink supply port 22, and the common pressure chamber 21 and each pressure chamber 14 are filled with the ink. An ink meniscus is formed in the nozzle by filling the pressure chamber 14 with the ink.

In this apparatus, when a drive signal generated from the drive signal generating unit 2 is applied between the individual electrode 17 and the common electrode 18, the actuator 16 corresponding to the individual electrode 17 is operated to be deformed. Thus, the vibration plate 12 is deformed, and the capacity of the corresponding pressure chamber 14 is changed to be expanded or contracted. In this manner, a pressure wave is generated in the pressure chamber 14, so that an ink droplet is ejected from the nozzle 20.

Figure 3:
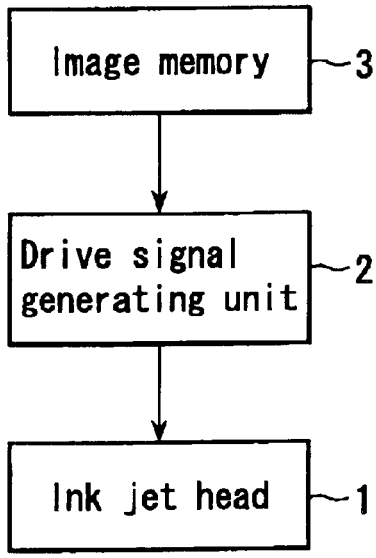
FIG. 3 is a block diagram depicting a configuration of a control unit in the same embodiment.

FIG. 3 is a control block diagram for carrying out gradation printing. The drive signal generating unit 2 reads gradation information from an image memory 3, and output a drive signal to the ink jet head 1.

Figure 4:
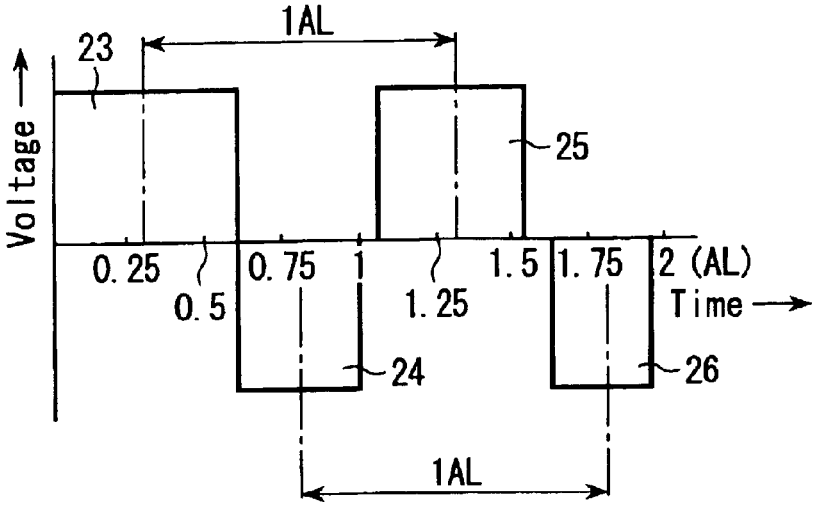
FIG. 4 is a view showing a configuration of a drive signal in the same embodiment.

The drive signal generated from the drive signal generating unit 2, as shown in FIG. 4, includes: a first pulse 23 formed in the shape of a rectangular shape, which expands the capacity of the pressure chamber 14; a second pulse 24 which contracts the capacity of the pressure chamber 14; a third pulse 25 formed in the shape of a rectangular shape, which expands the capacity of the pressure chamber 14; and a fourth pulse 26 which contracts the capacity of the pressure chamber 14. The drive signal generating unit 2 sequentially generates these four pulses 23, 24, 25, and 26, and causes one liquid droplet to be ejected from the nozzle 20. In the present embodiment, the voltage amplitude of each pulse is equal to that of one another.

Assuming that ½ of an acoustic resonant cycle of the ink in the pressure chamber 14 is 1 AL, a time interval between a pulse width center of the first pulse 23 and a pulse width center of the third pulse 25 is set to 1 AL, and a time interval between a pulse width center of the second pulse 24 and a pulse width center of the fourth pulse 26 is set to 1 AL.

1 AL can be obtained from a frequency at which an impedance of the actuator 16 is minimized due to resonance of the ink in the pressure chamber 14 by measuring the impedance of the actuator 16 of the ink jet head 1 filled with ink by using a commercialized impedance analyzer. In addition, 1 AL can be obtained by measuring a voltage which is induced to the actuator by an ink pressure vibration by using a synchroscope or the like and then, checking a vibration cycle of that voltage.

Further, a ratio of a pulse width of the third pulse 25 to a pulse width of the first pulse width 23 is a value which is determined depending on a damping rate of the residual vibration of the ink in the pressure chamber 14. Here, the ratio is set to 0.8. A ratio of a pulse width of the fourth pulse 26 to a pulse width of the second pulse width 24 is also set to 0.8.

Note that a damping rate of the residual vibration of the ink in the pressure chamber 14 is a specific value which is determined depending on a flow passage of the ink jet head 1, dimensions of the nozzle 20, and physical properties of the ink.

In this way, the time interval between the pulse width center of the first pulse 23 and the pulse width center of the third pulse 25 is set to 1 AL, whereby a phase of the pressure vibration generated at the first pulse 23 and a phase of the pressure vibration generated at the third pulse 25 enter a mutually inverted state.

In addition, a ratio of the pulse width of the third pulse 25 to the pulse width of the first pulse 23 is determined depending on a damping rate of the residual vibration of the ink in the pressure chamber 14. From this fact, an amplitude of the pressure vibration generated by the third pulse 25 can be equalized to that of the residual pressure vibration generated by the first pulse.

In this manner, the pressure vibration generated at the first pulse 23 is almost canceled at the third pulse 25 and the pressure vibration generated at the second pulse 24 also is almost canceled at the fourth pulse 26 based on its similar principle.

Moreover, while a sum of the pulse width of the first pulse 23 and the pulse width of the second pulse 24 is substantially maintained at 1 AL, when the pulse width of the first pulse 23 is reduced, and the pulse width of the second pulse 24 is increased, the meniscus retraction quantity before ink ejection is reduced. As a result, the volume of liquid droplets to be ejected can be increased. In contrast, when the pulse width of the first pulse 23 is increased, and the pulse width of the second pulse 24 is reduced, the meniscus retraction quantity before ink ejection is increased. As a result, the volume of liquid droplets ejected can be reduced.

Therefore, based on gradation information on pixels to be printed, the drive signal generating unit 2 can carry out gradation printing because the ink volume to be ejected changes when the rate of the pulse widths of the first pulse 23 and second pulse 24 is changed.

As described above, by changing both of the pulse width of the first pulse 23 and the pulse width of the second pulse 24, the volume to be ejected can be changed without significantly changing an ejection velocity.

When the pulse widths of the first pulse 23 and second pulse 24 are changed, the third pulse 25 and the fourth pulse 26 are also changed concurrently so that the time interval between the pulse width center of the first pulse 23 and the pulse width center of the third pulse 25 and the time interval between the pulse width center of the second pulse 24 and the pulse width center of the fourth pulse 26 are always set to 1 AL. In addition, the ratio between the pulse width of the first pulse 23 and the pulse width of the third pulse 25 and the ratio between the pulse width of the second pulse 24 and the pulse width of the fourth pulse 26 also are always set at a predetermined value. In this manner, even if a waveform is changed in order to change the ejection volume, a cancellation effect of pressure vibration can always be maintained.

Now, a computation result obtained by analyzing the ink jet head 1 in an acoustic engineering manner will be described below.

Figure 5:
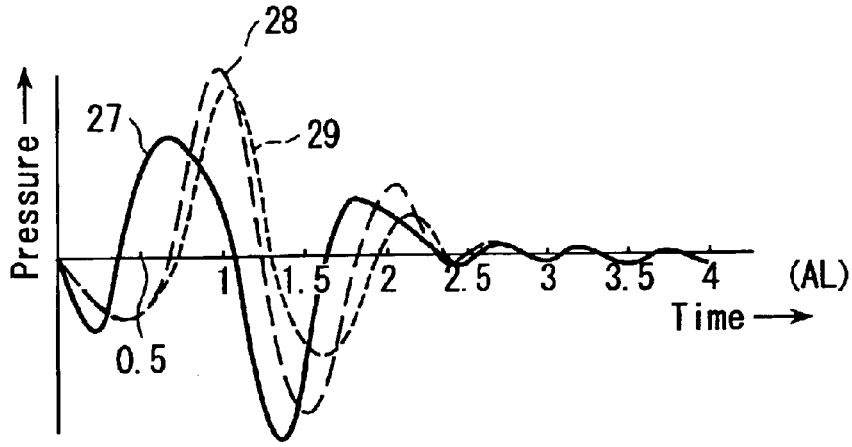
FIG. 5 is a waveform chart showing pressure vibration generated in a pressure chamber in the same embodiment.

FIG. 5 shows a pressure vibration waveform generated in the pressure chamber 14 when the drive signal from the drive signal generating unit 2 is applied between the electrodes 17 and 18. A waveform 27 is defined as a waveform when the pulse width of the first pulse 23 is set to 0.3 AL. A waveform 28 is defined as a waveform when the pulse width of the first pulse 23 is set to 0.6 AL. A waveform 29 is defined as a waveform when the pulse width of the first pulse 23 is set to 0.8 AL.

Figure 6:
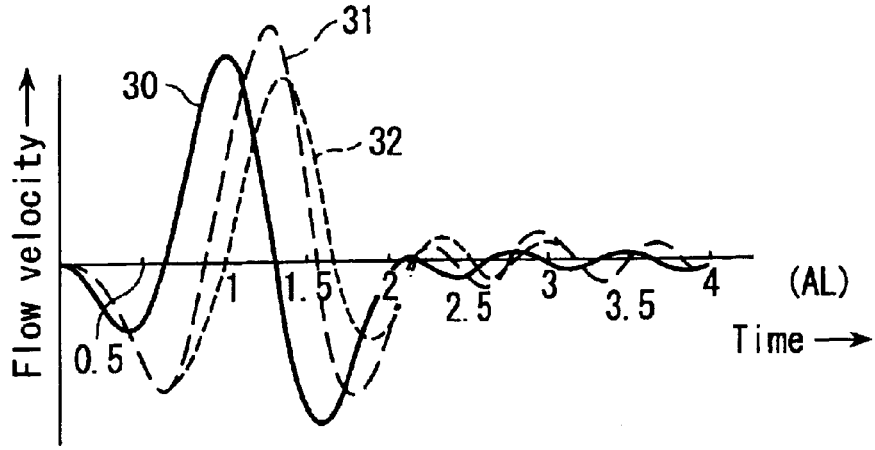
FIG. 6 is a waveform chart showing a flow velocity change in a nozzle in the same embodiment.

As a result of such pressure vibration generated in the pressure chamber 14, the flow velocity in the nozzle 20 changes as shown in FIG. 6. A waveform 30 is defined as a waveform when the pulse width of the first pulse 23 is set to 0.3 AL. A waveform 31 is defined as a waveform when the pulse width of the first pulse 23 is set to 0.6 AL. A waveform 32 is defined as a waveform when the pulse width of the first pulse 23 is set to 0.8 AL.

Figure 7:
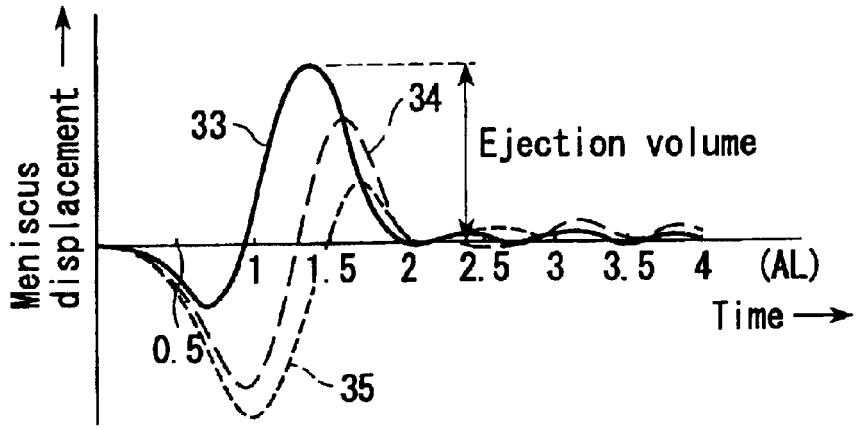
FIG. 7 is a waveform chart showing a meniscus displacement in the nozzle in the same embodiment.

Further, meniscus vibration as shown in FIG. 7 is generated in the nozzle 20. As shown in the figure, a component corresponding to a difference in maximum position of a meniscus displacement from an initial position of meniscus is obtained as an ejection volume, and an ink droplet is ejected. Note that a waveform 33 is defined as a waveform when the pulse width of the first pulse 23 is set to 0.3 AL, a waveform 34 is defined as a waveform when the pulse width of the first pulse 23 is set to 0.6 AL, and a waveform 35 is defined as a waveform when the pulse width of the first pulse 23 is set to 0.8 AL. Therefore, when the pulse width of the first pulse 23 is set to 0.3 AL, a large liquid droplet is produced. When the pulse width of the first pulse 23 is set to 0.6 AL, a middle liquid droplet is produced. When the pulse width of the first pulse 23 is set to 0.8 AL, a small liquid droplet is produced.

From the results shown in FIG. 5 to FIG. 7, in any case where the pulse width of the first pulse 23 is set to 0.3 AL, 0.6 AL, or 0.8 AL, it is evident that the residual vibration after ink ejecting operation is reduced to the minimum. Moreover, it can be seen from FIG. 7 that the ink ejection volume can be significantly changed by changing the pulse width of the first pulse 23 from 0.3 AL to 0.6 AL, and then, from 0.6 AL to 0.8 AL. However, the flow velocity during ink ejection does not differ from one another so much, as shown in FIG. 6. From this result, it has been found that advantageous effect that liquid droplets of a variety of volumes can be ejected at a substantially same velocity can be attained.

In this way, a deviation in ejection velocity or ejection volume due to the residual vibration generated by immediately preceding ink ejection operation or a deviation in ejection velocity due to types of liquid droplets to be ejected can be reduced; high gradation printing performance can be achieved with high printing precision, and a printing quality can be improved.

Figure 8:
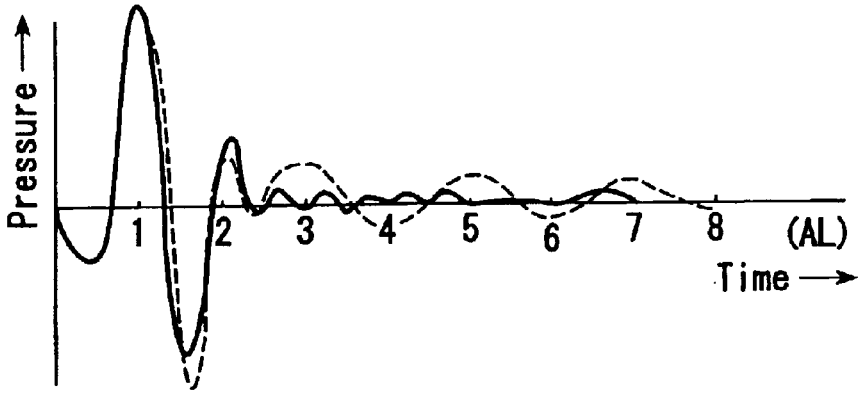
FIG. 8 is a waveform chart in which the pressure vibration in the same embodiment is compared with that of a prior art.
Figure 9:
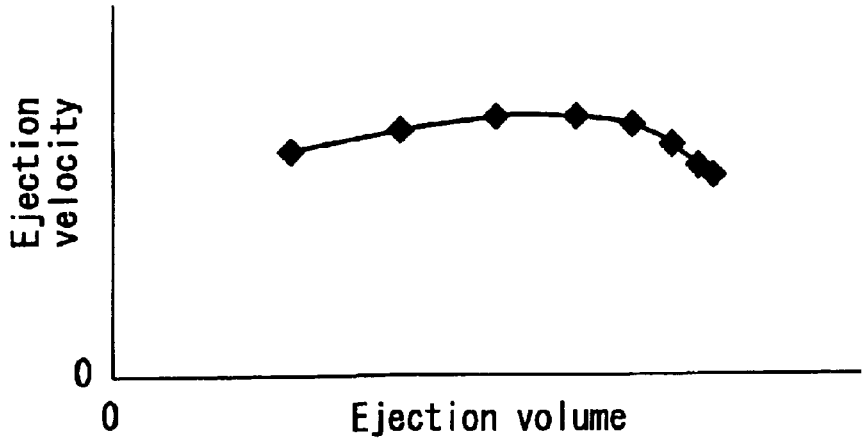
FIG. 9 is a graph depicting a relationship between an ejection velocity and an ejection volume in the same embodiment.

FIG. 8 is a waveform chart in which pressure vibration is compared with that of the prior art. It is found that the embodied waveform indicated by solid line in the figure is significantly reduced in residual vibration as compared with that of the prior art. With respect to a relationship between an ejection velocity and an ejection volume, as shown in FIG. 9, even if the ejection volume is reduced, the ejection velocity does not change so much, and is substantially constant. Therefore, the volume of ink droplets can be controlled while fluctuation of the ink ejection velocity is suppressed, and high gradation printing performance can be achieved with high printing precision.

Figure 10:
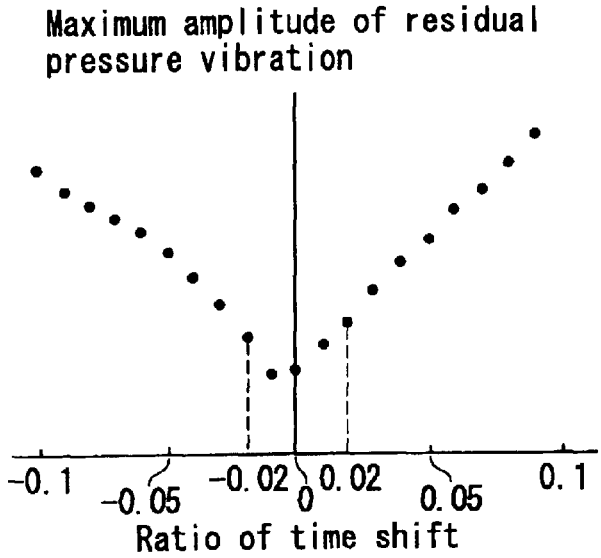
FIG. 10 is a graph depicting a relationship between a deviation from a time interval 1 AL and a maximum amplitude of the residual pressure vibration in the same embodiment.

Herein, with respect to a drive pulse for ink ejection, the time interval between the pulse width center of the first pulse 23 and the pulse width center of the third pulse 25, and the time interval between the pulse width center of the second pulse 24 and the pulse width center of the fourth pulse 26 are set to 1 AL, whereby the residual vibration after ink ejection is reduced. When a check has been made as to a maximum amplitude of the residual pressure vibration in the case where these time intervals are shifted from 1 AL, the result shown in FIG. 10 has been obtained.

From this result, when the time interval is close to 1 AL, a suppression effect of the residual pressure vibration is maximal. As the degree of the time interval shifted from 1 AL increases, the suppression effect of the residual pressure vibration is reduced. Even if the time interval is shifted by 2% (a time shift ratio: ±1.02), the shift is assumed to be efficiently equal to an actual value. In addition, even a further large shift can be allowed in application which does not require severe printing precision so much.

(Second Embodiment)

Like elements in the previously described embodiment are designated by like reference numerals.

Figure 11:
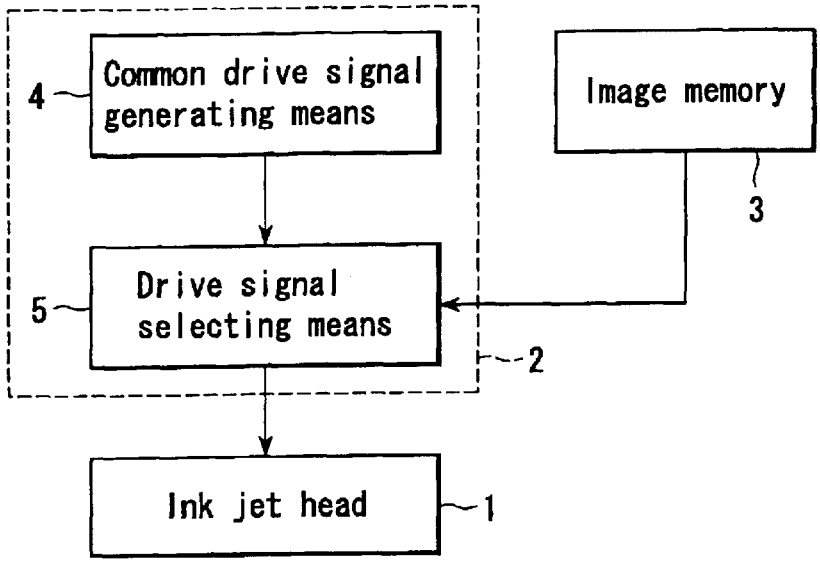
FIG. 11 is a block diagram depicting a configuration of a control unit in a second embodiment of the present invention.
Figure 12:
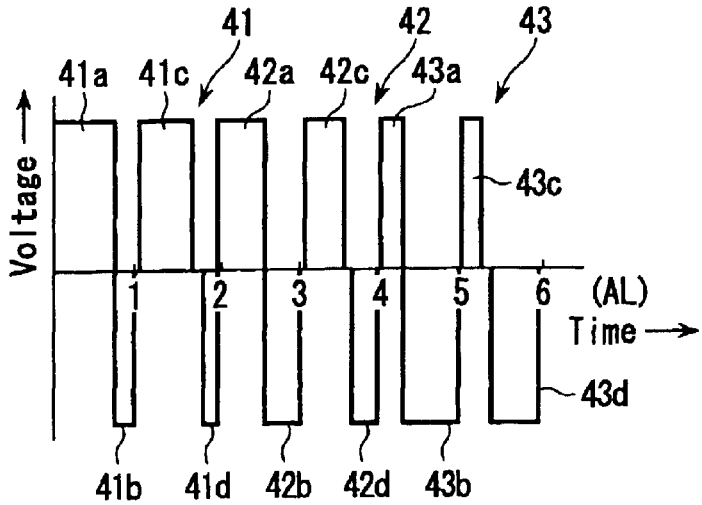
FIG. 12 is a view showing a configuration of a drive signal in the same embodiment.

As shown in FIG. 11, common drive signal generating means 4 is provided so as to generate a common drive signal shown in FIG. 12 from the common drive signal generating means 4.

This common drive signal is constituted of a pulse train having a sequence of a small-liquid-droplet drive signal 41 including a first pulse 41*a*, a second pulse 41*b*, a third pulse 41*c*, and a fourth pulse 41*d*; a middle-liquid-droplet drive signal 42 including a first pulse 42*a*, a second pulse 42*b*, a third pulse 42*c*, and a fourth pulse 42*d*; and a large-liquid-droplet drive signal 43 including a first pulse 43*a*, a second pulse 43*b*, a third pulse 43*c*, and a fourth pulse 43*d*. The pulse widths of the first pulses 41*a*, 42*a*, and 43*a* of the drive signals 41, 42, and 43 are set to 0.8 AL, 0.6 AL, and 0.3 AL, respectively. A ratio between the pulse width of the first pulse width 41*a* of the small-liquid-droplet drive signal 41 and the pulse width of the third pulse 41*c*; and a ratio between the pulse width of the second pulse 41*b* and the pulse width of the fourth pulse 41*d* are defined according to a damping rate of the residual vibration of the ink in the pressure chamber 14. The time interval between the pulse width center of the first pulse 41*a* and the pulse width center of the third pulse 41*c* is set to 1 AL, and the time interval between the pulse width center of the second pulse 41*b* and the pulse width center of the fourth pulse 41*d* is set to 1 AL, whereby the residual pressure vibration can be reduced in the same manner as that in the first embodiment. Here, a sum of the pulse width of the first pulse 41*a* and the pulse width of the second pulse 41*b* is substantially maintained at 1 AL. Also, the first to fourth pulses of the middle-liquid-droplet drive signal 42 and the large-liquid-droplet drive signal 43 are also set as in the first pulses 41*a* to 41*d* of the small-liquid-droplet drive signal 41.

A common drive signal from the common drive signal generating means 4 is supplied to drive signal selecting means 5. The drive signal selecting means 5 selects one or a plurality of the drive signal 41 for ejecting a small liquid droplet from a common drive signal; the dive signal 42 for ejecting a middle liquid droplet; and the drive signal 43 for ejecting a large liquid droplet, based on gradation information from the image memory 3 so as to apply it or them to the actuator 16 of the ink jet head 1.

In this way, the drive signal generating unit 2 is composed of the common drive signal generating means 4 and drive signal selecting means 5.

Figure 14:
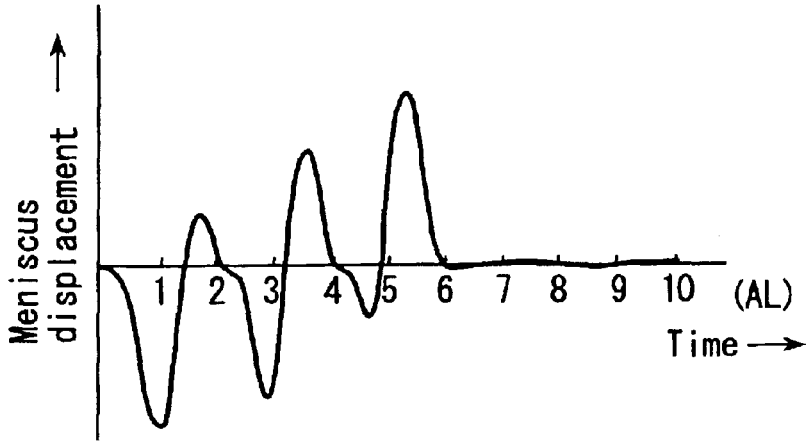
FIG. 14 is a waveform chart showing a meniscus displacement in the nozzle in the same embodiment.

For example, gradation printing in the same manner as that in the first embodiment described previously can be carried out by selecting one of the drive signals 41, 42, and 43. In addition, an ink with its large ejection volume can be adhered into one pixel by simultaneously selecting two or all of the drive signals 41, 42, and 43 for ejecting liquid droplets. That is, in the nozzle, a meniscus is displaced as shown in FIG. 14, and ink droplets relative to one or more selected drive signals are continuously ejected. As a result, an ink with its large ejection volume which cannot be obtained at the time of a single ejection operation can be adhered into one pixel.

Figure 13:
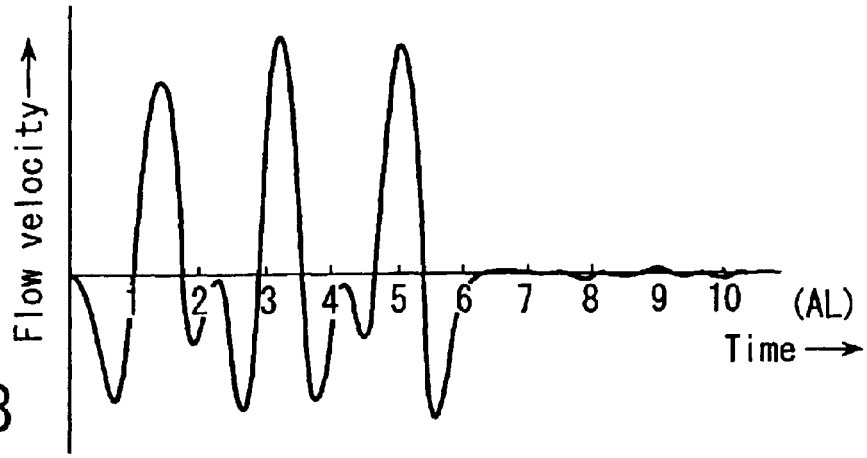
FIG. 13 is a waveform chart showing a flow velocity change in a nozzle in the same embodiment.

FIG. 13 shows a flow velocity change of the ink in the nozzle when the drive signal selecting means 5 selects all of the drive signals 41, 42, and 43 from the common drive signal generating means 4 and applies them to the actuator 16 of the ink jet head 1. In this way, the residual vibration after ejection operation of individual liquid droplets can be reduced, and thus, the ink flow velocity during ejection of each liquid droplet is substantially constant even when liquid droplets are continuously ejected. Thus, printing with high precision and small deviation of ejection velocity can be carried out.

Moreover, ink ejection is carried out by selecting one, two, or all of the small-liquid-droplet, middle-liquid-droplet, and large-liquid-droplet drive signals. Thus, the volume of ink adhered to one pixel can be changed significantly and finely, and gradation expression capability can be enhanced.

In the present embodiment, although the common drive signals from the common drive signal generating means 4 have been arranged in order of small-liquid-droplet, middle-liquid-droplet, and large-liquid-droplet drive signals, for example, they may be arranged in order of large-liquid-droplet, middle-liquid-droplet, and small-liquid-droplet drive signals without being limited thereto. When the common drive signals are thus set, inks are ejected in order of large, middle, and small liquid droplets by selecting all of the drive signals. Of course, ejection in any other order may be carried out.

In addition, in the present embodiment, although there has been described a common drive signal having a sequential train of small-liquid-droplet, middle-liquid-droplet, and large-liquid-droplet drive signals, a suitable pause time between the respective drive signals may be set without being limited thereto.

(Third Embodiment)

Figure 15:
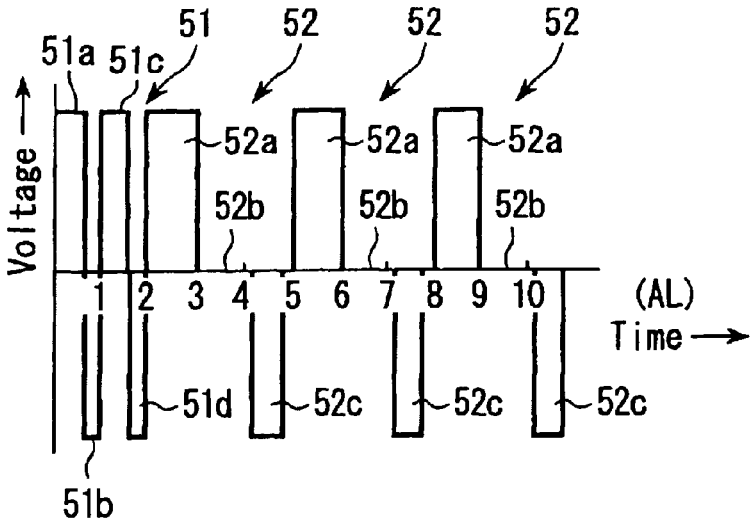
FIG. 15 is a view showing a configuration of a drive signal in a third embodiment of the present invention.

In the present embodiment as well, a configuration of a circuit to be used is identical to that shown in FIG. 11. A difference lies in a common drive signal generated from the common drive signal generating means 4, and lies in that a common drive signal having a pulse configuration shown in FIG. 15 is generated as a common drive signal.

This common drive signal is constituted of a pulse train having a sequence of: a small-liquid-droplet drive signal 51 including a first pulse 51*a*, a second pulse 51*b*, a third pulse 51*c*, and a fourth pulse 51*d*; and a plurality of large-liquid-droplet drive signals 52 each including a fifth pulse 52*a*, a predetermined wait time 52*b*, and a sixth pulse 52*c*. The voltage level of each of the pulses 52*a* and 52*c* of the large-liquid-droplet drive signal 52 is equalized to that of each of the pulses 51*a*, 51*b*, 51*c*, and 51*d* of the small-liquid-droplet drive signal 51, whereby a configuration of the common drive signal generating means 4 is prevented from being complicated. In addition, the ratio between the pulse width of the first pulse 51*a* of the small-liquid-droplet drive signal 51 and the pulse width of the third pulse 51*c*, and the ratio between the pulse width of the second pulse 51*b* and the pulse width of the fourth pulse 51*d* are defined according to a damping rate of the residual vibration of the ink in the pressure chamber 14. The time interval between the pulse width center of the first pulse 51*a* and the pulse width center of the third pulse 51*c* is set to 1AL, and the time interval between the pulse width center of the second pulse 51*b* and the pulse width center of the fourth pulse 51*d* is set to 1AL, whereby the residual pressure vibration can be reduced in the same manner as that in the first embodiment. Here, a sum of the pulse width of the first pulse 51*a* and the pulse width of the second pulse 51*b* is substantially maintained at 1AL.

In addition, in this common drive signal, the small-liquid-droplet drive signal 51 is composed of four voltage pulses, whereas the large-liquid-droplet drive signal 52 are composed of two voltage pulses. Therefore, when liquid droplets of the same size are repeatedly ejected, use of the large-liquid-droplet drive signal 52 reduces heat generation of the common drive signal generating means 4 due to generation of a voltage pulse or heat generation of the actuator due to application of a voltage pulse, thus making it possible to carry out printing at a high printing density for a long time.

In the large-liquid-droplet drive signal 52 as well, in order to sufficiently suppress the residual vibration after ink ejecting operation, the time interval between the pulse width center of the fifth pulse 52*a* which is an expansion pulse and the pulse width center of the sixth pulse 52*c* which is a contraction pulse is set to 2 AL. Here, a width of the fifth pulse 52*a* is set to 1 AL, and a width of the sixth pulse 52*c* is set to 0.6 AL. A ratio between the pulse width of the fifth pulse 52*a* and the pulse width of the sixth pulse 52*c* is defined according to a damping rate of the residual vibration of the ink in the pressure chamber 14.

Figure 17:
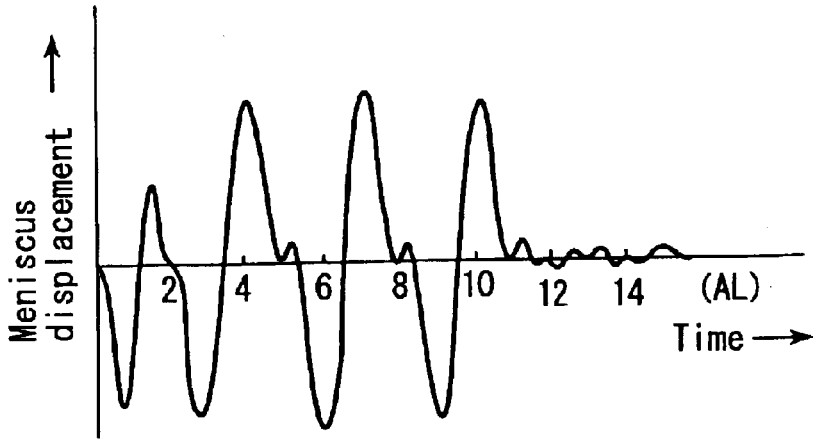
FIG. 17 is a waveform chart showing a meniscus displacement in the nozzle in the same embodiment.

In this way, the small-liquid-droplet drive signal 51 and the large-liquid-droplet drive signal 52 are combined with each other, whereby a meniscus displacement is generated as shown in FIG. 17, making it possible to change an ejection volume of a first liquid droplet and second and subsequent liquid droplets. Accordingly, a small liquid droplet and a large liquid droplet are selectively ejected, so that a volume of the ink adhered to one pixel can be changed significantly and finely. As a result, gradation expression capability can be enhanced.

Figure 16:
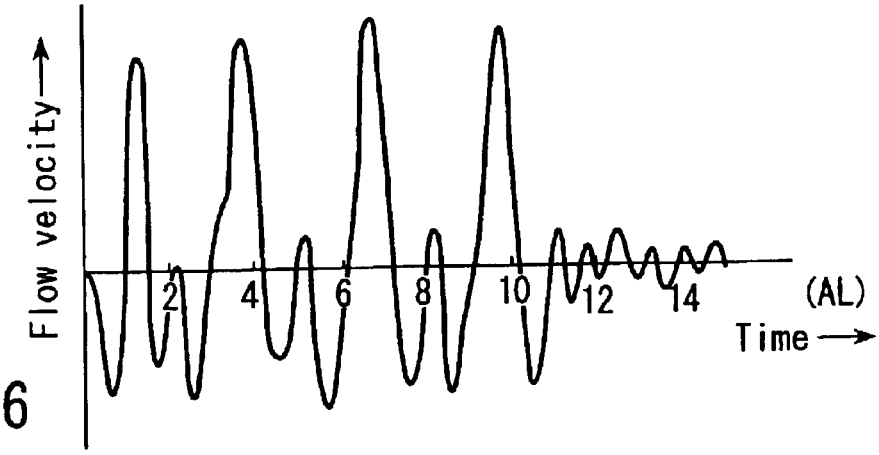
FIG. 16 is a waveform chart showing a flow velocity change in a nozzle in the same embodiment.

Further, as shown in FIG. 16, the ink flow velocity generated by the small-liquid-droplet drive signal 51 during ink ejection is substantially same to that generated by the large-liquid-droplet drive signal 52 during ink ejection. Thus, printing with high precision and small deviation in ejection velocity can be carried out.

In FIG. 15, although there has been provided a drive signal having a sequence of the small liquid droplet dive signal 51 followed by the large-liquid-droplet drive signal 52, ejecting operation may be carried out based on either of the waveforms. A drive signal may be provided in sequence of the large-liquid-droplet drive signal 52 followed by the small-liquid-droplet drive signal 51. Also in this case, the residual vibration can be sufficiently reduced. In addition, the number of the small and large-liquid-droplet drive signals 51 and 52 to be combined with each other is not limited to the above number. Thus, the ejection order and number of liquid droplets can be arbitrarily set.

In this way, the small-liquid-droplet drive signal 51 and the large-liquid-droplet drive signal 52 are combined with each other, whereby a high printing quality and printing precision can be obtained without making complicated a configuration of the common drive signal means 4.

(Fourth Embodiment)

Figure 18:
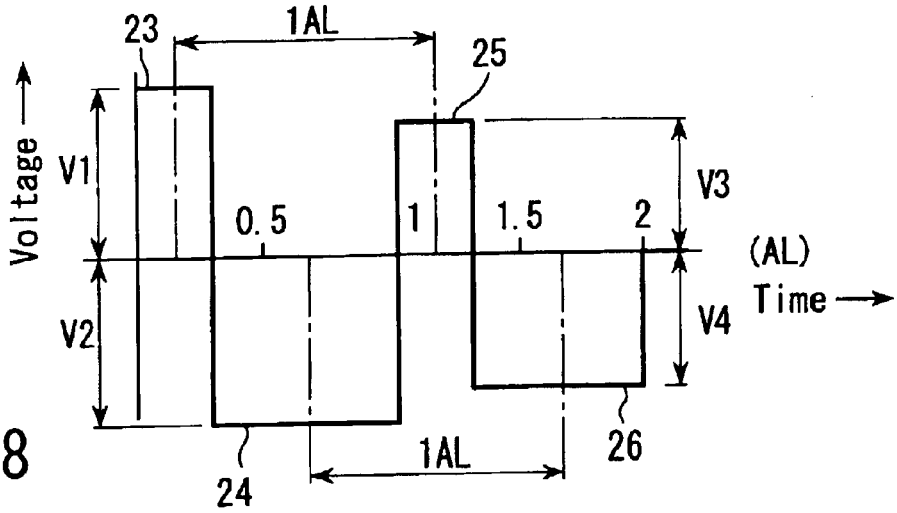
FIG. 18 is a view showing a configuration of a drive signal in a fourth embodiment of the present invention.

In the present embodiment as shown in FIG. 18, a ratio between a voltage amplitude V1 of the first pulse 23 and a voltage amplitude V3 of the third pulse is set according to a damping rate of the residual vibration of the ink in the pressure chamber 14. A ratio between a voltage amplitude V2 of the second pulse 24 and a voltage amplitude V4 of the fourth pulse 26 is also set according to a damping rate of the residual vibration of the ink in the pressure chamber 14. On the other hand, the pulse width of the first pulse 23 is set to be equal to that of the third pulse 25. In addition, the pulse width of the second pulse 24 is also set to be equal to that of the fourth pulse 26. However, a time interval between the pulse width center of the first pulse 23 and the pulse width center of the third pulse 25 is set so as to be 1 AL. A time interval between a pulse width center of the second pulse 24 and a pulse width center of the fourth pulse 26 is also set so as to be 1 AL.

Figure 19:
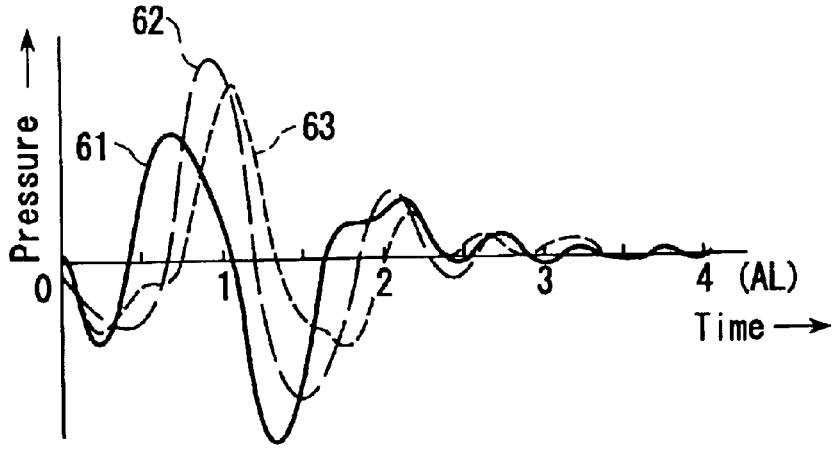
FIG. 19 is a waveform chart showing pressure vibration in the same embodiment.

In such an embodiment, as is the case of the first embodiment, the pressure vibration waveforms when the pulse widths of the first pulse 23 are 0.3 Al, 0.6 AL, and 0.8 AL are presented as a waveform 61, a waveform 62, and a waveform 63 of FIG. 19, respectively. In addition, the flow velocity in the nozzle 20 are presented in the shapes of a waveform 64, a waveform 65, and a waveform 66 of FIG. 20, respectively. Further, the meniscus displacements in the nozzle 20 are presented in the shape of a waveform 67, a waveform 68, and a waveform 69 of FIG. 21, respectively.

Figure 20:
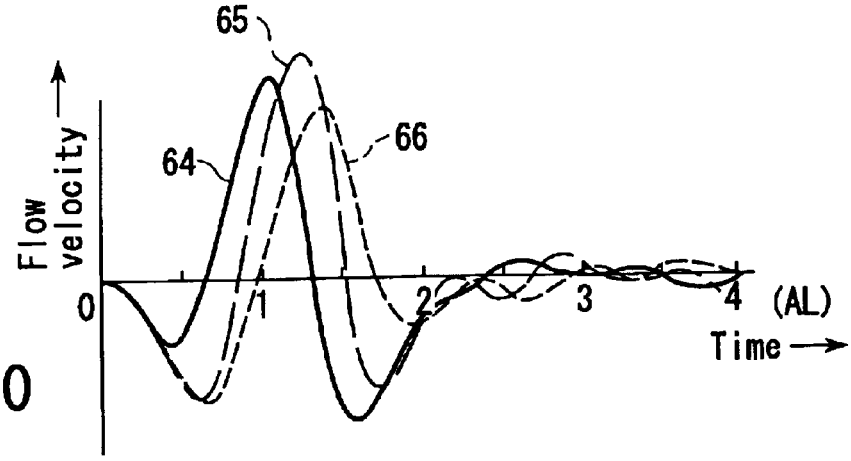
FIG. 20 is a waveform chart showing a flow velocity change in a nozzle in the same embodiment.
Figure 21:
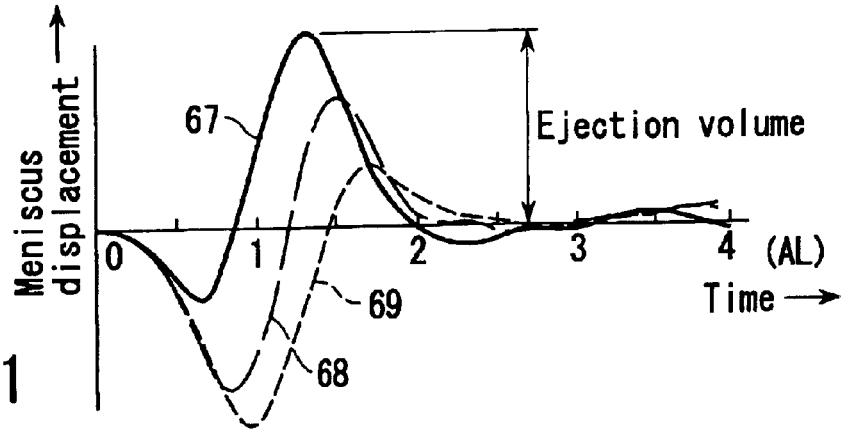
FIG. 21 is a waveform chart showing a meniscus displacement in the nozzle in the same embodiment.

As can be seen from FIG. 19 to FIG. 21 described above, in the fourth embodiment also, an ink volume to be ejected can be changed while the same ejection velocity is maintained, by changing a width of the first pulse 23, and it is found that the residual pressure vibration after ejecting operation is small, in the same manner as that in the first embodiment.

(Fifth Embodiment)

Figure 22:
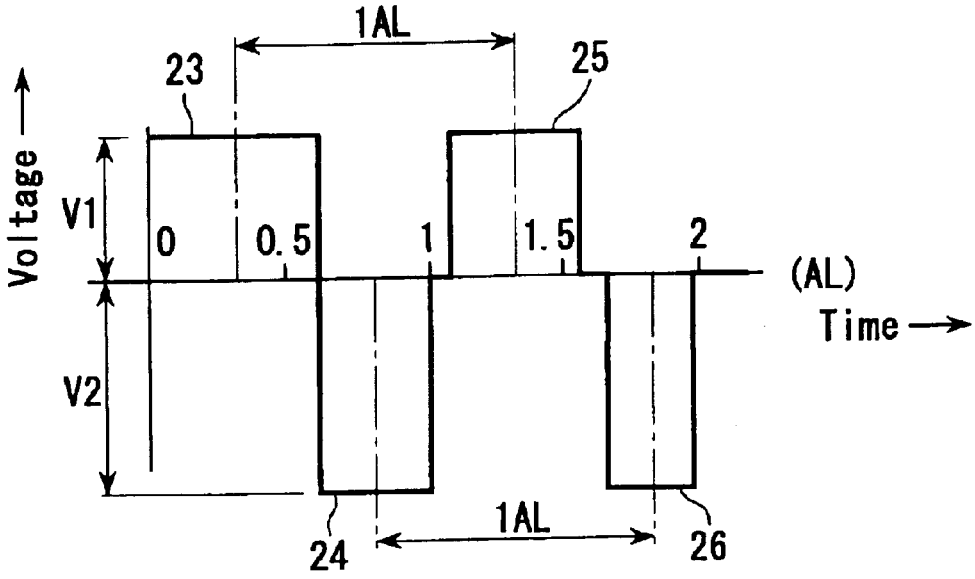
FIG. 22 is a view showing a configuration of a drive signal in a fifth embodiment of the present invention.
Figure 23:
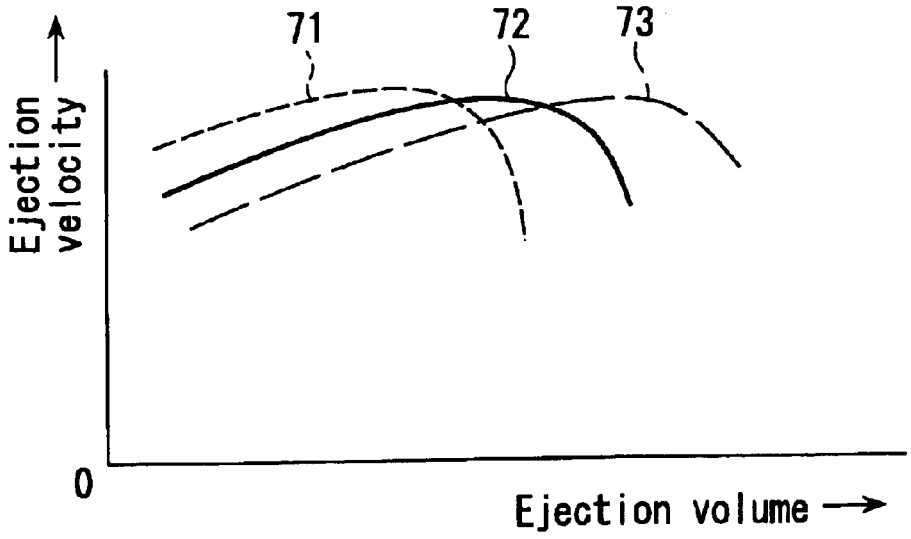
FIG. 23 is a view showing a relationship between an ejection volume and an ejection velocity in the same embodiment.

The present embodiment is different from the first embodiment, as shown in FIG. 22, in that the voltage amplitude V1 of the first pulse 23 differs from the voltage amplitude V2 of the second pulse. Thus, change of a ratio between a voltage amplitude of a pulse for expanding the pressure chamber 14 and a voltage amplitude of a pulse for contracting the pressure chamber 14 changes a relationship between an ejection volume and an ejection velocity when the first pulse 23 is changed, as shown in FIG. 23. A curve 71 is produced when V1:V2=6:4, a curve 72 is produced when V1:V2=1:1, i.e., in the case of the first embodiment, and a curve 73 is produced when V1:V2=4:6.

As shown in FIG. 23, when the voltage amplitude V1 is set to be greater than the voltage amplitude V2, the ejection velocity when the ejection volume is small increases, making it easy to eject a small liquid droplet. On the other hand, when the voltage amplitude V1 is set to be smaller than the voltage amplitude V2, the ejection velocity when the ejection volume is large increases, making it easy to eject a large liquid droplet. Therefore, gradation characteristics in conformance with a range of ejection volume targeted to be changed can be obtained by adjusting a ratio between the voltage amplitude V1 and the voltage amplitude V2.

Even in the case where the voltage amplitude V1 is thus obtained as a value which is different from the voltage amplitude V2, a ratio between the pulse width of the first pulse 23 and the pulse width of the third pulse 25, and a ratio between the pulse width of the second pulse 24 and the pulse width of the fourth pulse 26 are defined according to a damping rate of the residual vibration of the ink in the pressure chamber 14. Note that the time interval between the pulse width center of the first pulse 23 and the pulse width center of the third pulse 25 is set to 1 AL, and the time interval between the pulse width center of the second pulse 24 and the pulse width center of the fourth pulse 26 is set to 1 AL, so that the residual pressure vibration can be reduced in the same manner as that in the first embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet head driving apparatus comprising:

an ink jet head having a pressure chamber which contains ink, a nozzle communicating with the pressure chamber, through which the ink in the pressure chamber is ejected in the form of a droplet to a recording medium, and an actuator which changes a capacity of the pressure chamber to be expanded or contracted; and a drive signal generating unit which outputs a drive signal including a first, second, third and fourth pulses sequentially applied to the ink jet head for ejecting one ink droplet by the actuator, the first pulse having a first rectangular wave which expands the capacity of the pressure chamber, the second pulse having a second rectangular wave which contracts the capacity of the pressure chamber, the third pulse having a third rectangular wave which expands the capacity of the pressure chamber, and the fourth pulse having a fourth rectangular wave which contracts the capacity of the pressure chamber, wherein both a first time interval between centers of pulse widths of the first and third pulses and a second time interval between centers of pulse widths of the second and fourth pulses are respectively set to half of an acoustic resonant cycle of the ink in the pressure chamber.

2. An ink jet head driving apparatus according to claim 1, wherein a first ratio of the pulse widths of the first and third pulses and a second ratio of the pulse widths of the second and fourth pulses are determined, respectively, according to a damping rate of residual vibration of the ink in the pressure chamber.

3. An ink jet head driving apparatus according to claim 1, wherein the pulse widths of the first and third pulses are set to be equal to one another and the pulse widths of the second and fourth pulses are set to be equal to one another, a third ratio of voltage amplitudes of the first and third pulses and a fourth ratio of voltage amplitudes of the second and fourth pulses being determined, respectively, according to a damping rate of residual vibration of the ink in the pressure chamber.

4. An ink jet head driving apparatus according to claim 1, wherein the drive signal generating unit sequentially generates a plurality of the drive signals so that the ink jet head ejects a plurality of the ink droplets resulting in adherence at one point on the recording medium, whereby one pixel is formed.

5. An ink jet head driving apparatus comprising:

an ink jet head having a pressure chamber which contains ink, a nozzle communicating with the pressure chamber, through which the ink in the pressure chamber is ejected in the form of a droplet, and an actuator which changes a capacity of the pressure chamber to be expanded or contracted; and a drive signal generating unit which outputs a drive signal including a first, second, third and fourth pulses sequentially applied to the ink jet head for ejecting one ink droplet by the actuator, the first pulse having a rectangular wave which expands the capacity of the pressure chamber, the second pulse having a second rectangular wave which contracts the capacity of the pressure chamber, the third pulse having a third rectangular wave which has a pulse width of a predetermined rate with respect to a pulse width of the first pulse, and expands the capacity of the pressure chamber, and the fourth pulse having a fourth rectangular wave which has a pulse width of a predetermined rate with respect to a pulse width of the second pulse, and contracts the capacity of the pressure chamber, wherein a sum of the pulse widths of the first and second pulses is constant, and a rate of the pulse widths of the first and second pulses is obtained as a value according to a desired ejection volume.

6. An ink jet head driving apparatus according to claim 5, wherein the drive signal generating unit sequentially generates a plurality of the drive signals so that the ink jet head ejects a plurality of the ink droplets resulting in adherence at one point on a recording medium, whereby one pixel is formed.

7. An ink jet head driving apparatus comprising:

an ink jet head having a pressure chamber which contains ink, a nozzle communicating with the pressure chamber, through which the ink in the pressure chamber is ejected in the form of a droplet, and an actuator which changes a capacity of the pressure chamber to be expanded or contracted, and a drive signal generating unit which selectively generates a first drive signal and a second drive signal, each of which is output to the ink jet head for ejecting one ink droplet by the actuator, according to a desired ejection volume of the ink droplet, wherein the first drive signal includes a first, second, third and fourth pulses sequentially applied to the ink jet head for ejecting one ink droplet by the actuator, the first pulse having a first rectangular wave which expands the capacity of the pressure chamber, the second pulse having a second rectangular wave which contracts the capacity of the pressure chamber, the third pulse having a third rectangular wave which expands the capacity of the pressure chamber, and the fourth pulse having a fourth rectangular wave which contracts the capacity of the pressure chamber, wherein both a first time interval between centers of pulse widths of the first and third pulses and a second time interval between centers of pulse widths of the second and fourth pulses are respectively set to half of an acoustic resonant cycle of the ink in the pressure chamber, wherein the second drive signal includes a fifth and sixth pulses sequentially generated with a predetermined wait time therebetween, the fifth pulse having a fifth rectangular wave which expands the capacity of the pressure chamber, and the sixth pulse having a sixth rectangular wave which contracts the capacity of the pressure chamber, and wherein a time interval between centers of pulse widths of the fifth and sixth pulses is set to the acoustic resonant cycle.

8. An ink jet head driving apparatus according to claim 7, wherein the drive signal generating unit maintains a sum of the pulse widths of the first and second pulses of the first drive signal at a constant value, and varies a ratio between the pulse widths of the first and second pulses to change a volume of each ink droplet to be ejected from the ink jet head.

* * * * *